US006671383B2

(12) United States Patent
Usuki et al.

(10) Patent No.: US 6,671,383 B2
(45) **Date of Patent: *Dec. 30, 2003**

(54) ELECTROMAGNETIC TRANSDUCER AND PORTABLE COMMUNICATION DEVICE

(75) Inventors: Sawako Usuki, Hyogo (JP); Shuji Saiki, Nara (JP)

(73) Assignee: Matsushita Electric Industrial Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 96 days.

(21) Appl. No.: 09/433,129

(22) Filed: Nov. 3, 1999

(65) Prior Publication Data

US 2003/0123691 A1 Jul. 3, 2003

(30) Foreign Application Priority Data

Nov. 4, 1998 (JP) ..... 10-312923

(51) Int. Cl.[7] ..... H04R 25/00

(52) U.S. Cl. ..... 381/396; 381/412; 381/414; 381/431

(58) Field of Search ..... 381/191, 396, 381/398, 408, 412, 414, 417, 418, 419, 420, 431, FOR 163

(56) References Cited

U.S. PATENT DOCUMENTS

| | | | | | |
|---|---|---|---|---|---|
| 1,913,318 | A | * | 6/1933 | Greibach | 381/417 |
| 2,794,862 | A | * | 6/1957 | Topholm | 381/417 |
| 2,848,560 | A | * | 8/1958 | Wiegand et al. | 381/417 |
| 3,092,693 | A | * | 6/1963 | Hayasaka et al. | 381/417 |
| 3,324,253 | A | * | 6/1967 | Uemura et al. | 381/417 |
| 4,330,878 | A | | 5/1982 | Nakamura | |
| 5,422,656 | A | | 6/1995 | Allard et al. | |
| 5,923,769 | A | * | 7/1999 | Fushimi | 381/396 |
| 5,960,096 | A | | 9/1999 | Imahori et al. | |
| 6,154,557 | A | * | 11/2000 | Montour et al. | 381/396 |

FOREIGN PATENT DOCUMENTS

| | | |
|---|---|---|
| EP | 650308 | 4/1995 |
| EP | 1128359 | 8/2001 |
| JP | 53-77491 | 7/1978 |
| JP | 62-47318 | 10/1987 |
| WO | WO00/70905 | 11/2000 |

* cited by examiner

*Primary Examiner*—Curits Kuntz
*Assistant Examiner*—Suhan Ni
(74) *Attorney, Agent, or Firm*—RatnerPrestia

(57) ABSTRACT

An electromagnetic transducer, includes: a first diaphragm disposed in a vibratile manner; a second diaphragm provided in a central portion of the first diaphragm, the second diaphragm being formed of a magnetic material; a yoke disposed in a position opposing the first diaphragm; a center pole provided on a face of the yoke that opposes the first diaphragm; a coil substantially surrounding the center pole; a magnet substantially surrounding the coil; and a thin magnetic plate provided between the magnet and the first diaphragm, an inner periphery of the thin magnetic plate being in overlapping relation to an outer periphery of the second diaphragm.

23 Claims, 10 Drawing Sheets

PRIOR ART

ELECTROMAGNETIC TRANSDUCER AND PORTABLE COMMUNICATION DEVICE

FIELD OF THE INVENTION

The present invention relates to an electroacoustic transducer for use in a portable communication device, e.g., a cellular phone or a pager, for reproducing an alarm sound responsive to a received call.

BACKGROUND OF THE INVENTION

FIGS. 9A and 9B show a plan view and a cross-sectional view, respectively, of a conventional electroacoustic transducer of an electromagnetic type (hereinafter referred to as an "electromagnetic transducer"). The conventional electromagnetic transducer includes a cylindrical housing 107 and a disk-shaped yoke 106 disposed so as to cover the bottom face of the housing 107. A center pole 103, which may form an integral part of the yoke 106, is provided in a central portion of the yoke 106. A coil 104 is wound around the center pole 103. Spaced from the outer periphery of the coil 104 is provided an annular magnet 105, with an appropriate interspace maintained between the coil 104 and the inner periphery of the annular magnet 105 around the entire circumference thereof. The outer peripheral surface of the magnet 105 is abutted with the inner peripheral surface of the housing 107. An upper end of the housing 107 supports a first diaphragm 100 which is made of a non-magnetic disk so that an appropriate interspace exists between the first diaphragm 100 and the magnet 105, the coil 104, and the center pole 103. In a central portion of the first diaphragm 100, a second diaphragm 101 which is made of a magnetic disk is provided so as to be concentric with the first diaphragm 100.

Now, the operation and effects of the above-described conventional electromagnetic transducer will be described. In an initial state where no current flows through the coil 104, a magnetic path is formed by the magnet 105, the second diaphragm 101, the center pole 103, and the yoke 106. As a result, the second diaphragm 101 is attracted toward the magnet 105 and the center pole 103, up to a point of equilibrium with the elastic force of the first diaphragm 100. If an alternating current flows through the coil 104 in this initial state, an alternating magnetic field is generated in the aforementioned magnetic path, so that an driving force is generated on the second diaphragm 101. Such driving force generated on the second diaphragm 101 causes the second diaphragm 101 to vibrate from its initial state, along with the fixed first diaphragm 100, due to interaction with the attraction force which is generated by the magnet 105. This vibration is transmitted as sound. However, in the illustrated structure, the distance between the magnet 105 and the second diaphragm 101 is so large that the magnetic flux cannot sufficiently act on the second diaphragm 101.

FIG. 10 shows a magnetic flux vector diagram of the conventional electromagnetic transducer shown in FIGS. 9A and 9B. This magnetic flux vector diagram only illustrates one of the two halves with respect to a central axis (shown at the left of the figure), and the first diaphragm 100 and the housing 107 are omitted from illustration because they are non-magnetic. As seen from FIG. 10, a large magnetic gap exists in the magnetic path from the magnet 105 to the second diaphragm 101 of the conventional electromagnetic transducer. As a result, a large layer of air in the magnet gap serves as magnetic resistance, thereby making it difficult to supply sufficient magnetic flux from the magnetic path in the central portion of the magnet 105 to the second diaphragm 101.

It would seem possible to employ a first diaphragm 100 which is composed of a magnetic material so that the first diaphragm 100 can itself be utilized as a magnetic path. In this case, however, it would be difficult to form the first diaphragm 100 with a thickness which allows it to be utilized as a magnetic path while preventing magnetic saturation, especially if the first diaphragm 100 is designed so as to have a resonance frequency equal to the frequency which is intended to be reproduced as an alarm sound.

SUMMARY OF THE INVENTION

An electromagnetic transducer according to the present invention includes: a first diaphragm disposed in a vibratile manner; a second diaphragm provided in a central portion of the first diaphragm, the second diaphragm being formed of a magnetic material; a yoke disposed in a position opposing the first diaphragm; a center pole provided on a face of the yoke that opposes the first diaphragm; a coil substantially surrounding the center pole; a magnet substantially surrounding the coil; and a thin magnetic plate provided between the magnet and the first diaphragm, an inner periphery of the thin magnetic plate being in overlapping relation to an outer periphery of the second diaphragm.

In one embodiment of the invention, the first diaphragm, the magnet, and the yoke form an enclosed space.

In another embodiment of the invention, at least one of the first diaphragm, the magnet, and the yoke includes at least one air hole for allowing the enclosed space to communicate with the exterior of the enclosed space.

In still another embodiment of the invention, the electromagnetic transducer further includes a housing, the first diaphragm being provided in the housing.

In still another embodiment of the invention, the first diaphragm and the housing form an enclosed space.

In still another embodiment of the invention, at least one of the first diaphragm and the housing includes at least one air hole for allowing the enclosed space to communicate with the exterior of the enclosed space.

In still another embodiment of the invention, the first diaphragm, the housing, and the yoke form an enclosed space.

In still another embodiment of the invention, at least one of the first diaphragm, the housing, and the yoke includes at least one air hole for allowing the enclosed space to communicate with the exterior of the enclosed space.

In still another embodiment of the invention, the at least one air hole is provided in a position along a diameter of the yoke located outside an outer periphery of the magnet.

In still another embodiment of the invention, a length of radial overlap between an outer diameter of the second diaphragm and an inner diameter of the thin magnetic plate accounts for about 4% to about 15% of the outer diameter of the second diaphragm.

In still another embodiment of the invention, an inner diameter of the thin magnetic plate is equal to or smaller than an inner diameter of the magnet.

In still another embodiment of the invention, the magnet includes a recessed portion on a face thereof opposing the first diaphragm at an inner periphery thereof, the thin magnetic plate being snugly received by the recessed portion.

In still another embodiment of the invention, an outer periphery of the thin magnetic plate substantially coincides with a neutral point at which directions of magnetic flux vectors occurring on a surface of the magnet become diversified so that some of the magnetic flux vectors traverse toward the center pole while others traverse toward an outer periphery of the magnet.

In still another embodiment of the invention, the second diaphragm includes a plurality of projections, each of which extends in a radial direction, the plurality of projections being formed along a circumference direction of the second diaphragm.

In still another embodiment of the invention, a material substantially composing the first diaphragm has a specific gravity which is equal to or smaller than a specific gravity of a material substantially composing the second diaphragm.

In another aspect of the invention, there is provided a portable communication device incorporating any one of the aforementioned electromagnetic transducers.

Thus, the invention described herein makes possible the advantage of providing a high-performance electroacoustic transducer of an electromagnetic type in which a thin magnetic plate is provided between a magnet and a first diaphragm so as to complement the magnetic path between the magnet and a second diaphragm, thereby effectively generating attraction force and driving force on the second diaphragm, this being possible without substantial change in the size of the magnet and the second diaphragm.

This and other advantages of the present invention will become apparent to those skilled in the art upon reading and understanding the following detailed description with reference to the accompanying figures.

DETAILED DESCRIPTION OF THE INVENTION

Hereinafter, the present invention will be described by way of illustrative examples, with reference to the accompanying figures.

EXAMPLE 1

Figure 1:
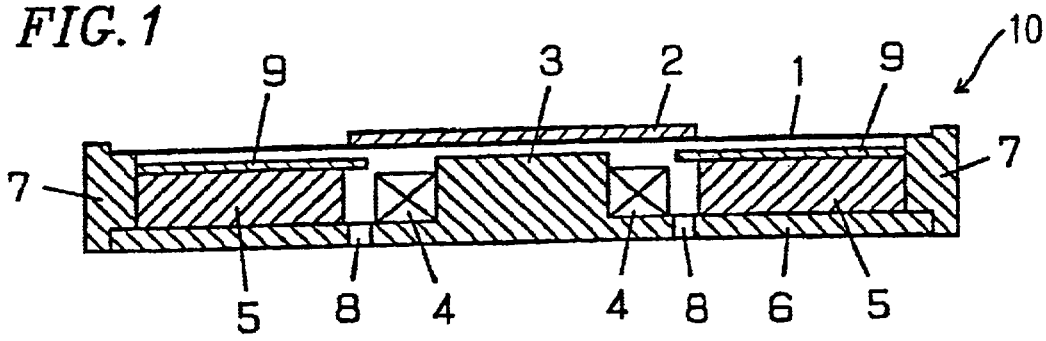
FIG. 1 is a cross-sectional view illustrating an electromagnetic transducer according to Example 1 of the present invention.

An electromagnetic transducer 10 according to Example 1 of the present invention will be described with reference to FIGS. 1 and 2. FIG. 1 is a cross-sectional view illustrating the electromagnetic transducer 10 according to Example 1 of the present invention. As shown in FIG. 1, the electromagnetic transducer 10 includes a cylindrical housing 7 and a disk-shaped yoke 6 disposed so as to cover the bottom face of the housing 7. A center pole 3, which may form an integral part of the yoke 6, is provided in a central portion of the yoke 6. A coil 4 is wound around the center pole 3. Spaced from the outer periphery of the coil 4 is provided an annular magnet 5, with an appropriate interspace maintained between the coil 4 and the inner periphery of the annular magnet 5 around the entire circumference thereof. The outer peripheral surface of the magnet 5 is abutted with the inner peripheral surface of the housing 7. On the upper face of the magnet 5, a thin annular magnetic plate 9 is provided so as to cover the entire upper face of the magnet 5. A tip end of the center pole 3 is located within the inner circumference of the thin magnetic plate 9. The inner diameter of the thin magnetic plate 9 is smaller than the inner diameter of the magnet 5, so that the inner periphery of the thin magnetic plate 9 extends beyond the inner circumference of the magnet 5. An upper end of the housing 7 supports a first diaphragm 1, which is made of a non-magnetic disk, in a manner to allow vibration of the first diaphragm 1. An appropriate interspace exists between the first diaphragm 1 and the thin magnetic plate 9, the coil 4, and the center pole 3. In a central portion of the first diaphragm 1, a second diaphragm 2 which is made of a magnetic (e.g., permalloy) disk is provided so as to be concentric with the first diaphragm 1. The inner diameter of the thin magnetic plate 9 is smaller than the outer diameter of the second diaphragm 2, so that the inner periphery of the thin magnetic plate 9 is in at least partial overlapping relation to the outer periphery of the second diaphragm 2. A plurality of air holes 8 are formed at predetermined intervals along the circumferential direction in the yoke 6 for allowing the space between the coil 4 and the inner peripheral surface of the magnet 5 to communicate with the exterior space lying outside the space between the first diaphragm 1 and the yoke 6. Each air hole 8 allows the air existing between the coil 4 and the inner peripheral surface of the magnet 5 to be released to the exterior so as to reduce the acoustic load on the first diaphragm 1.

Next, the operation and effects of the above-described electromagnetic transducer will be described. In an initial state where no current flows through the coil 4, a magnetic path is formed by the magnet 5, the thin magnetic plate 9, the second diaphragm 2, the center pole 3, and the yoke 6. As a result, the second diaphragm 2 is attracted toward the magnet 5 and the center pole 3, up to a point of equilibrium with the elastic force of the first diaphragm 1. If an alternating current flows through the coil 4 in this initial state, an alternating magnetic field is generated in the aforementioned magnetic path, so that an driving force is generated on the second diaphragm 2. Such driving force generated on the second diaphragm 2 causes the second diaphragm 2 to vibrate from its initial state, along with the fixed first diaphragm 1, due to interaction with the attraction force which is generated by the magnet 5. This vibration is transmitted as sound.

According to the present example, the thin magnetic plate 9 provided between the magnet 5 and the second diaphragm 2 functions to reduce the magnetic resistance, thereby increasing the magnetic flux density in the magnetic path. As a result, the driving force on the second diaphragm 2 is increased, causing the first diaphragm 1 and the second diaphragm 2 to vibrate with an increased amplitude, thereby resulting in a substantial increase in the reproduced sound pressure level. It is believed that the thin magnetic plate 9 introduces a 71% improvement in the attraction force, and a 43% improvement in the driving force, over the conventional structure which lacks the thin magnetic plate 9.

Figure 2:
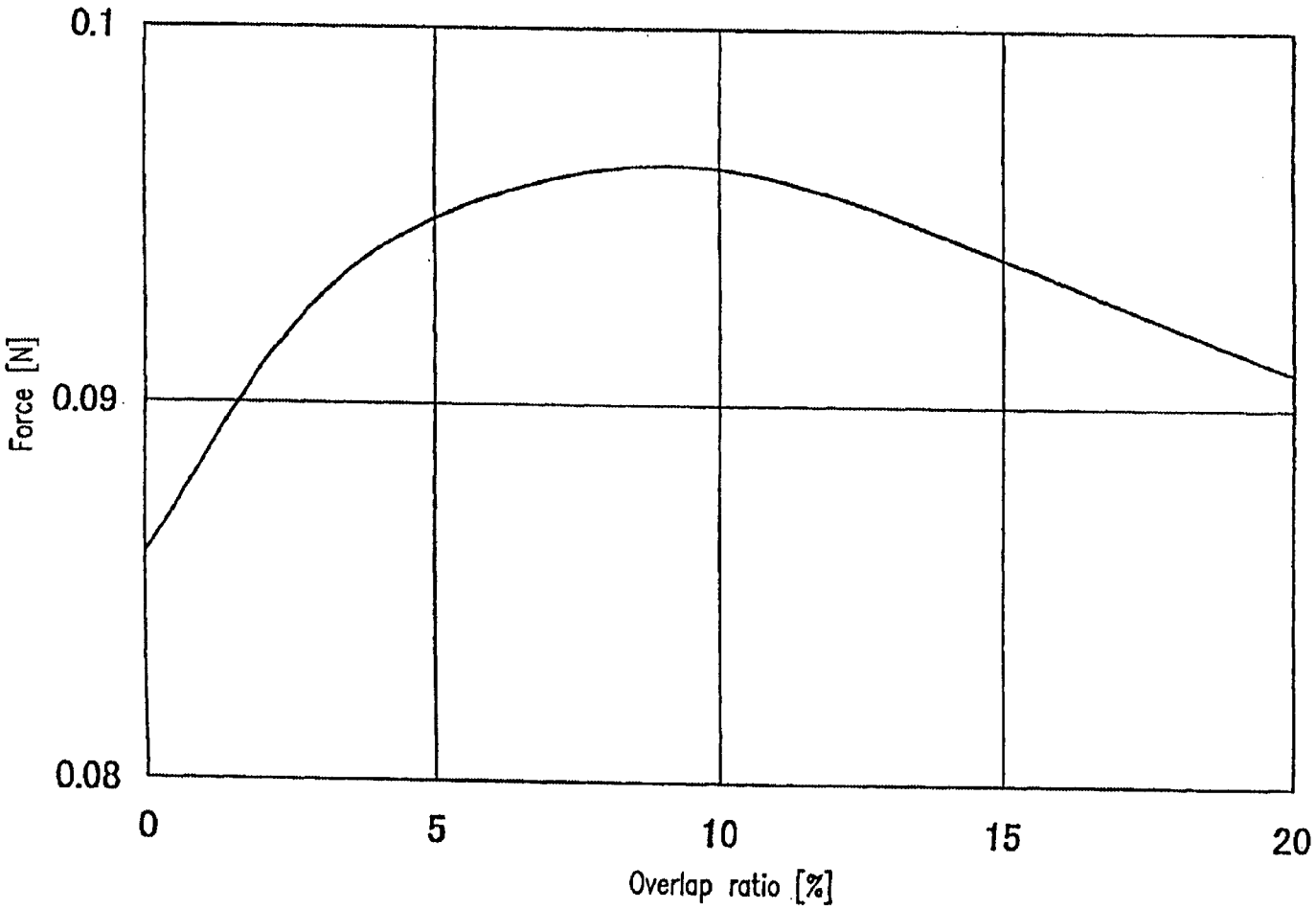
FIG. 2 is a graph illustrating the relationship between driving force and an overlap ratio between the inner diameter of a thin magnetic plate and the outer diameter of a second diaphragm according to Example 1 of the present invention.

FIG. 2 is a graph illustrating the relationship between driving force and an overlap ratio between the inner diameter of a thin magnetic plate and the outer diameter of a second diaphragm according to Example 1 of the present invention. As used herein, the "overlap ratio" is defined as a ratio of the length of radial overlap between the inner diameter of the thin magnetic plate 9 and the outer diameter of the second diaphragm 2 with respect to the outer diameter of the second diaphragm 2. In the graph of FIG. 2, the horizontal axis represents the overlap ratio, whereas the vertical axis represents the driving force. It will be seen in FIG. 2 that the driving force becomes maximum with an overlap ratio of about 9%. At the overlap ratio of about 5%, there is a 21% improvement in the attraction force, and a 10% improvement in the driving force, over the respective values attained at the overlap ratio of 0% (i.e., the inner diameter of the thin magnetic plate 9 equaling the outer diameter of the second diaphragm 2 so that there is no overlap). Thus, it will be seen from the graph of FIG. 2 that the overlap ratio is preferably in the range of about 4% to about 15% for further enhancement in the driving force.

Although the thin magnetic plate 9 illustrated in the electromagnetic transducer according to Example 1 of the present invention shown in FIG. 1 has an inner diameter which is smaller than the inner diameter of the magnet 5, the inner diameter of the thin magnetic plate 9 may be equal to or greater than the inner diameter of the magnet 5 so long as the inner diameter of the thin magnetic plate 9 is smaller than the outer diameter of the second diaphragm 2. The thin magnetic plate 9 does not need to be in contact with the magnet 5 so long as the thin magnetic plate 9 is located between the magnet 5 and the first diaphragm 1. The thin magnetic plate 9 preferably has a thickness for preventing magnetic saturation in order to minimize the magnetic resistance and increase the magnet flux density within the magnet path.

Although a thin annular magnetic plate 9 is illustrated above, the thin annular magnetic plate 9 can have any configuration defined by an outer diameter and an inner diameter, e.g., a complete ring or disrupted fractions of a ring.

EXAMPLE 2

Figure 3:
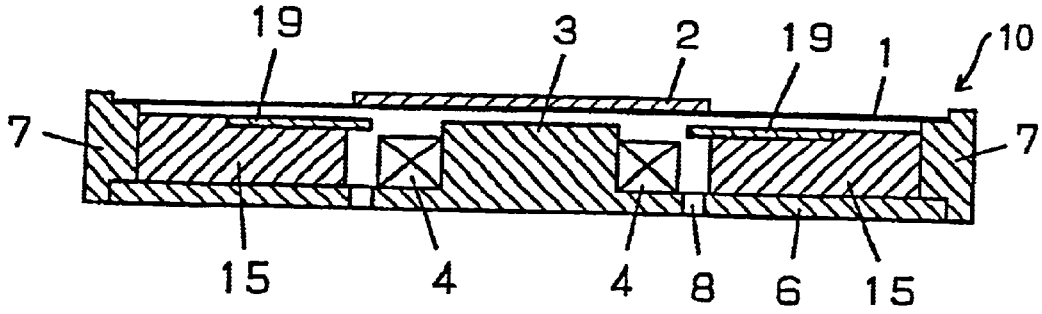
FIG. 3 is a cross-sectional view illustrating an electromagnetic transducer according to Example 2 of the present invention.

FIG. 3 is a cross-sectional view illustrating an electromagnetic transducer according to Example 2 of the present invention. In the electromagnetic transducer shown in FIG. 3, a recessed portion for snugly receiving a thin magnetic plate 19 is provided at the inner periphery of the upper face of a magnet 15 for affixing the thin magnetic plate 19 to the magnet 15. Otherwise, the electromagnetic transducer 10 of the present example has the same structure as that of the electromagnetic transducer 10 according to Example 1 shown in FIG. 1. The inner periphery of the thin magnetic plate 19 extends beyond the inner circumference of the magnet 15; that is, the inner diameter of the thin magnetic plate 19 is smaller than the inner diameter of the magnet 15.

In accordance with the electromagnetic transducer of the present example, since the thin magnetic plate 19 is snugly received by the recessed portion formed in the magnet 15, the overall height of the electromagnetic transducer 10 can be reduced without substantially decreasing the attraction force generated by the magnet 15 and the driving force on the second diaphragm 2.

Figure 4:
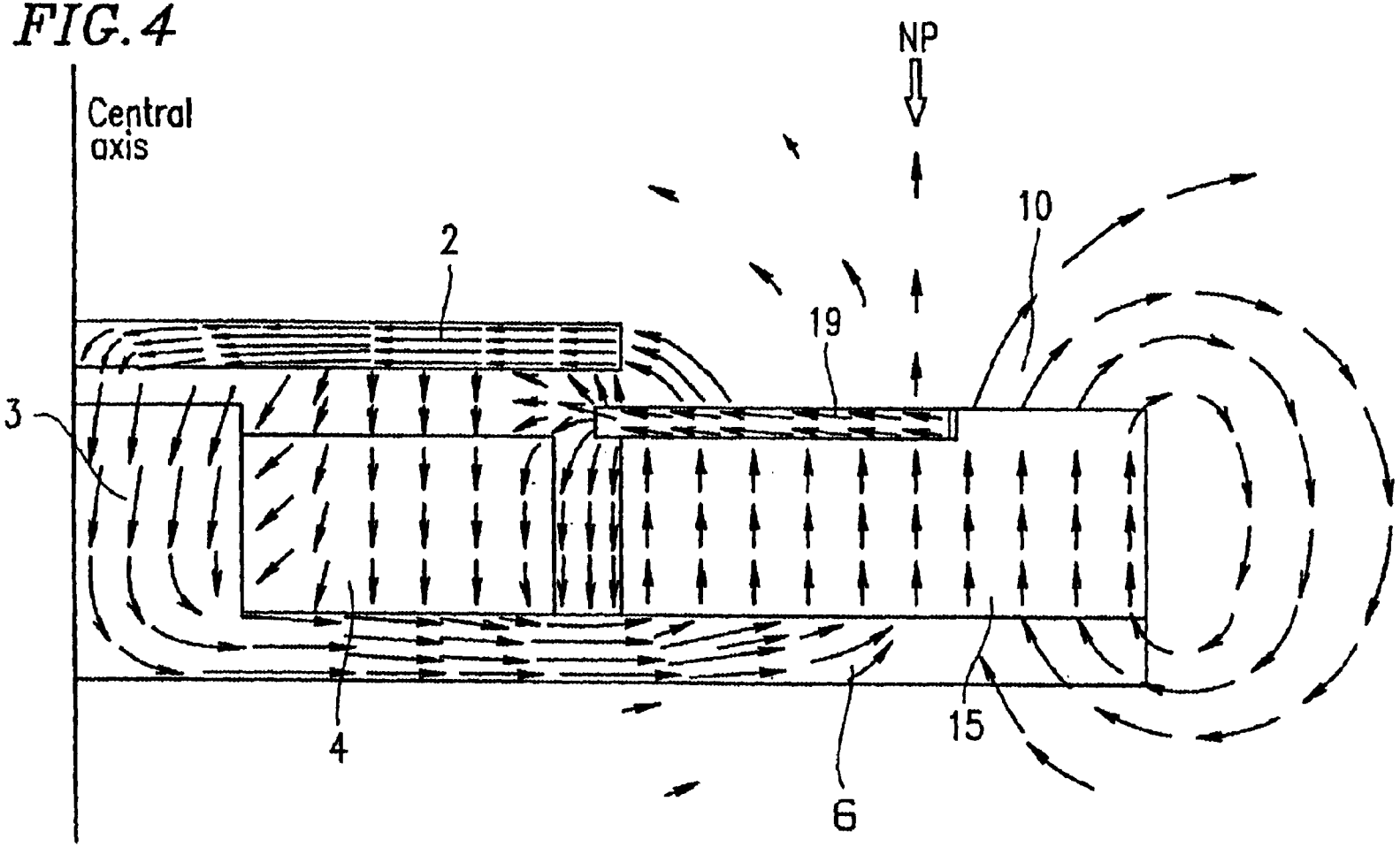
FIG. 4 is a magnetic flux vector diagram of the electromagnetic transducer according to Example 2 of the present invention.

FIG. 4 is a magnetic flux vector diagram of the electromagnetic transducer 10 shown in FIG. 3. This magnetic flux vector diagram only illustrates one of the two halves with respect to a central axis (shown at the left of the figure), and the first diaphragm 1 and the housing 7 are omitted from the illustration because they are non-magnetic. Holes 8 are also omitted in FIG. 4 for clearer illustration of the magnetic path. As shown in FIG. 4, at a neutral point (denoted as NP) along the radius direction of the magnet 15, the directions of the magnetic flux vectors occurring on the magnet 15 become diversified so that some of them traverse toward the central axis while others traverse toward the outer periphery of the magnet 15. The thin magnetic plate 19 provided on the magnet 15 functions to cause the magnetic flux traveling toward the central axis to be concentrated around the inner periphery of the magnet 15, so that the concentrated magnetic flux can effectively enter the second diaphragm 2. Since the layer of air within the magnetic path between the magnet 15 and the second diaphragm 2 is reduced by the presence of the thin magnetic plate 19, a corresponding decrease in the magnetic resistance results which makes it possible to effectively supply magnetic flux to the second diaphragm 2.

As mentioned above, the directions of the magnetic flux vectors occurring on the magnet 15 become diversified at the neutral point NP so that some of them traverse toward the central axis while others traverse toward the outer periphery of the magnet 15. For this reason, it will be appreciated that the thin magnetic plate 19 can most effectively cause the magnetic flux traveling toward the central axis to be concentrated around the inner periphery of the magnet 15 when the electromagnetic transducer 10 is designed so that the outer diameter of the thin magnetic plate 19 equals the maximum diameter at which magnetic flux traveling toward the central axis can occur, i.e., so that the outer periphery of the thin magnetic plate 19 substantially coincides with the neutral point NP of the magnet 15.

Figure 5:
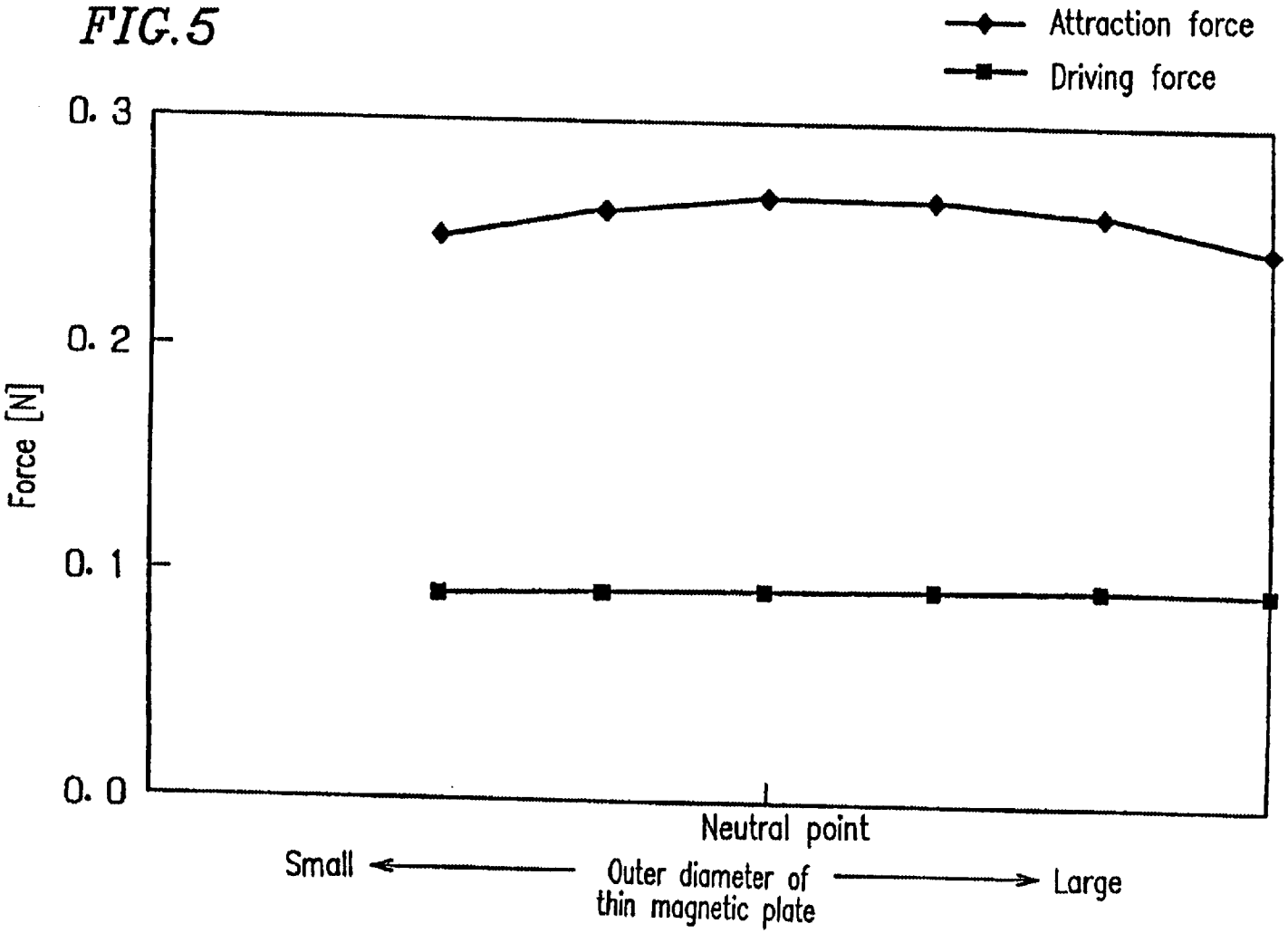
FIG. 5 is a graph illustrating the relationship between the outer diameter of a thin magnetic plate, attraction force, and driving force according to Example 2 of the present invention.

FIG. 5 is a graph illustrating the relationship between the outer diameter of the thin magnetic plate 19 and the attraction force and driving force applied to the second diaphragm 2. In the graph of FIG. 5, the horizontal axis represents the outer diameter of the thin magnetic plate 19, whereas the vertical axis represents the attraction force and the driving force applied to the second diaphragm 2. It will be seen from FIG. 5 that the attraction force becomes maximum at the neutral point (shown as NP in FIG. 4) of the magnet 15.

EXAMPLE 3

Figure 6:
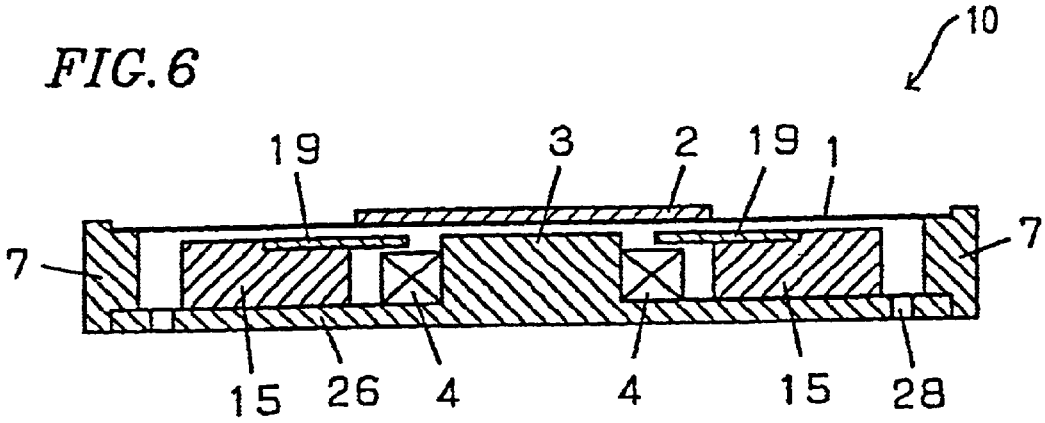
FIG. 6 is a cross-sectional view illustrating an electromagnetic transducer according to Example 3 of the present invention.

FIG. 6 is a cross-sectional view illustrating an electromagnetic transducer 10 according to Example 3 of the present invention. In the electromagnetic transducer shown in FIG. 6, a magnet 15 is provided so that an interspace exists between the outer peripheral surface of the magnet 15 and the inner peripheral surface of a housing 7, and a plurality of air holes 28 are formed at predetermined intervals along the circumferential direction in a yoke 26. The air holes 28 allow the interspace between the outer peripheral surface of the magnet 15 and the inner peripheral surface of the housing 7 to communicate with the exterior space lying outside the space between a first diaphragm 1 and the yoke 26. Otherwise the electromagnetic transducer 10 of the present example has the same structure as that of the electromagnetic transducer 10 according to Example 2 shown in FIG. 3.

In accordance with the electromagnetic transducer 10 of the present example, the air existing between the outer peripheral surface of the magnet 15 and the inner peripheral surface of the housing 7 is released to the exterior through the air holes 28. Since the air holes 28 are provided at the outer periphery of the yoke 26, it is possible to dispose the magnet 15 so as to be closer to the center of the yoke 26. In addition, the airway between the first diaphragm 1 and the air holes 28 is not blocked by a thin magnetic plate 19 because the air holes 28 are provided at the outer periphery of the yoke 26. This makes it easier to sufficiently reduce the inner diameter of the thin magnetic plate 19 so that the inner periphery of the thin magnetic plate 19 is in overlapping relation to the coil 4 as desired, which in turn makes it possible to reduce the outer diameter of the second diaphragm 2 (which is in at least partial overlapping relation to the inner periphery of the thin magnetic plate 19). A reduced outer diameter of the second diaphragm 2 would be advantageous because an elastic support portion of the first diaphragm 1, i.e., the portion other than the portions which actually support the second diaphragm 2, can be correspondingly increased, thereby allowing the second diaphragm 2 to vibrate with a larger amplitude. A larger vibration amplitude of the second diaphragm 2 provides for a higher reproduced sound pressure level.

EXAMPLE 4

Figure 7A:
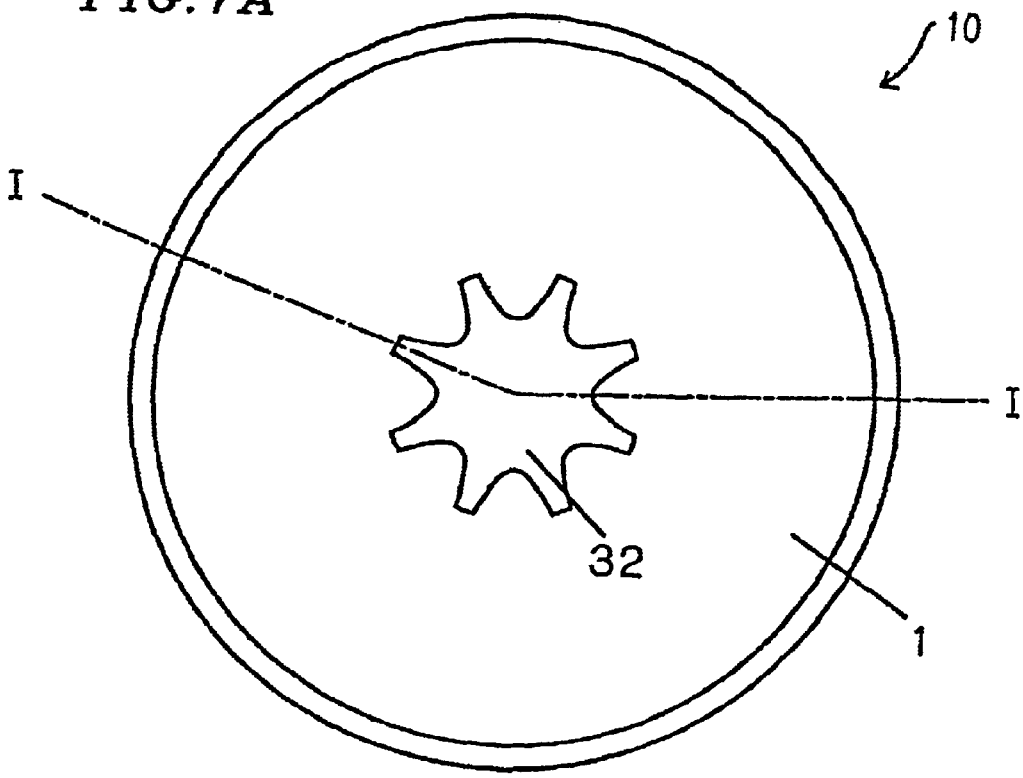
FIG. 7A is a plan view illustrating an electromagnetic transducer according to Example 4 of the present invention.
Figure 7B:
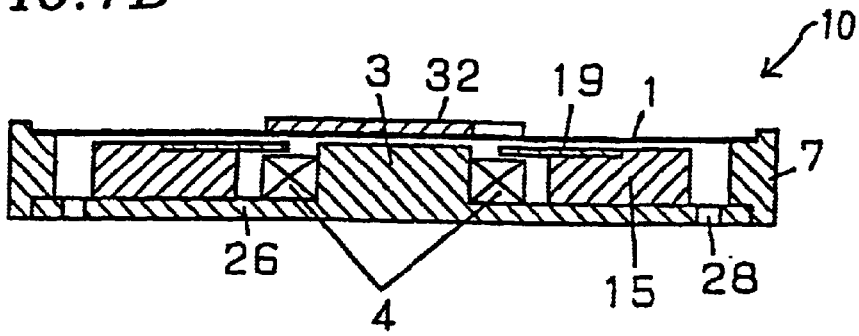
FIG. 7B is a cross-sectional view of the electromagnetic transducer shown in FIG. 7A.

FIG. 7A is a plan view illustrating an electromagnetic transducer according to Example 4 of the present invention. FIG. 7B is a cross-sectional view taken at line I—I in FIG. 7A. In the electromagnetic transducer shown in FIGS. 7A and 7B, a second diaphragm 32 which is fixed in the central portion of a first diaphragm 1 has a plurality of notches in the periphery of its disk shape, resulting in a plurality of projections extending in the radial direction and equally intervaled along the circumference direction. Each projection (as viewed from above in FIG. 7A) has a contour in the manner of a quadric curve such that the sum total of the cross-sectional areas of all of the projections, taken along a direction perpendicular to each radius direction, remains constant regardless of which point along each radius direction such cross sections are taken. The thickness of the second diaphragm 32 is preferably larger than that of the first diaphragm 1. Otherwise, the electromagnetic transducer 10 of the present example has the same structure as that of the electromagnetic transducer 10 according to Example 3 shown in FIG. 6.

In Examples 1 to 3, the second diaphragm 2 has a disk-like shape so that the sum total of the cross-sectional areas taken along its circumferential direction (i.e., the direction perpendicular to each radius direction) is inconstant along the radius direction, i.e., increases as such cross sections are taken at a point farther away from the inner periphery. The magnetic flux density within a given magnetic body is in inverse proportion with the cross-sectional area through which the magnetic flux passes. Therefore, the magnetic flux within the second diaphragm 2 is inconstant along the radius direction. In contrast, according to Example 4, each projection (as viewed from above) has a contour in the manner of a quadric curve such that the sum total of the cross-sectional areas of all of the projections, taken along a direction perpendicular to each radius direction, remains constant regardless of which point along each radius direction such cross sections are taken, as mentioned above. Therefore, the magnetic flux is constant along the notched outer periphery of the second diaphragm 32 according to the present example.

By forming the aforementioned notches in the second diaphragm 32 within the constraints for preventing magnetic saturation, the amount of magnetic flux passing through the second diaphragm 32 (Example 4) can be kept substantially the same as the amount of magnetic flux passing through the second diaphragm 2 (Examples 1 to 3), thereby obtaining the same size of driving force on the second diaphragm 32 as on the second diaphragm 2. As a result, the second diaphragm 32 with constant magnet flux density can reproduce sounds through vibration, without substantial characteristic degradation.

The electromagnetic transducer 10 shown in FIGS. 7A and 7B is capable of reproducing still higher sound pressure levels because the overall mass of the first diaphragm 1 and the second diaphragm 32 is reduced by the notches in the periphery of the second diaphragm 32 (as described above, the second diaphragm 32 is preferably thicker than the first diaphragm 1). The projections of the second diaphragm 32 are preferably disposed on portions of the second diaphragm 32 lying outside (i.e., toward the outer periphery) of the portion which opposes the center pole 3 of the second diaphragm 32.

In the electromagnetic transducer shown in FIGS. 7A and 7B, the mass of the diaphragms 1 and 32 is reduced by forming notches in the otherwise-disk-shaped second diaphragm 32. However, the mass of the diaphragms 1 and 32 can also be reduced for similar effects by employing a material for the first diaphragm 1 which has a relatively small specific gravity. For example, instead of forming the first diaphragm 1 from permalloy (similarly to the second diaphragm 32), the first diaphragm 1 may alternatively be formed from titanium, which has a relatively small specific gravity.

In the electromagnetic transducer 10 according to Examples 2 to 4 as illustrated in FIGS. 3, 6, and 7A and 7B, the thin magnetic plate 19 has an inner diameter which is smaller than the inner diameter of the magnet 15. However, the inner diameter of the thin magnetic plate 19 may be equal to or greater than the inner diameter of the magnet 15 so long as the inner diameter of the thin magnetic plate 19 is smaller than the outer diameter of the second diaphragm 2 or 32. The thin magnetic plate 19 preferably has a thickness for preventing magnetic saturation in order to increase the magnetic flux density within the magnetic path by minimizing magnetic resistance.

Figure 8:
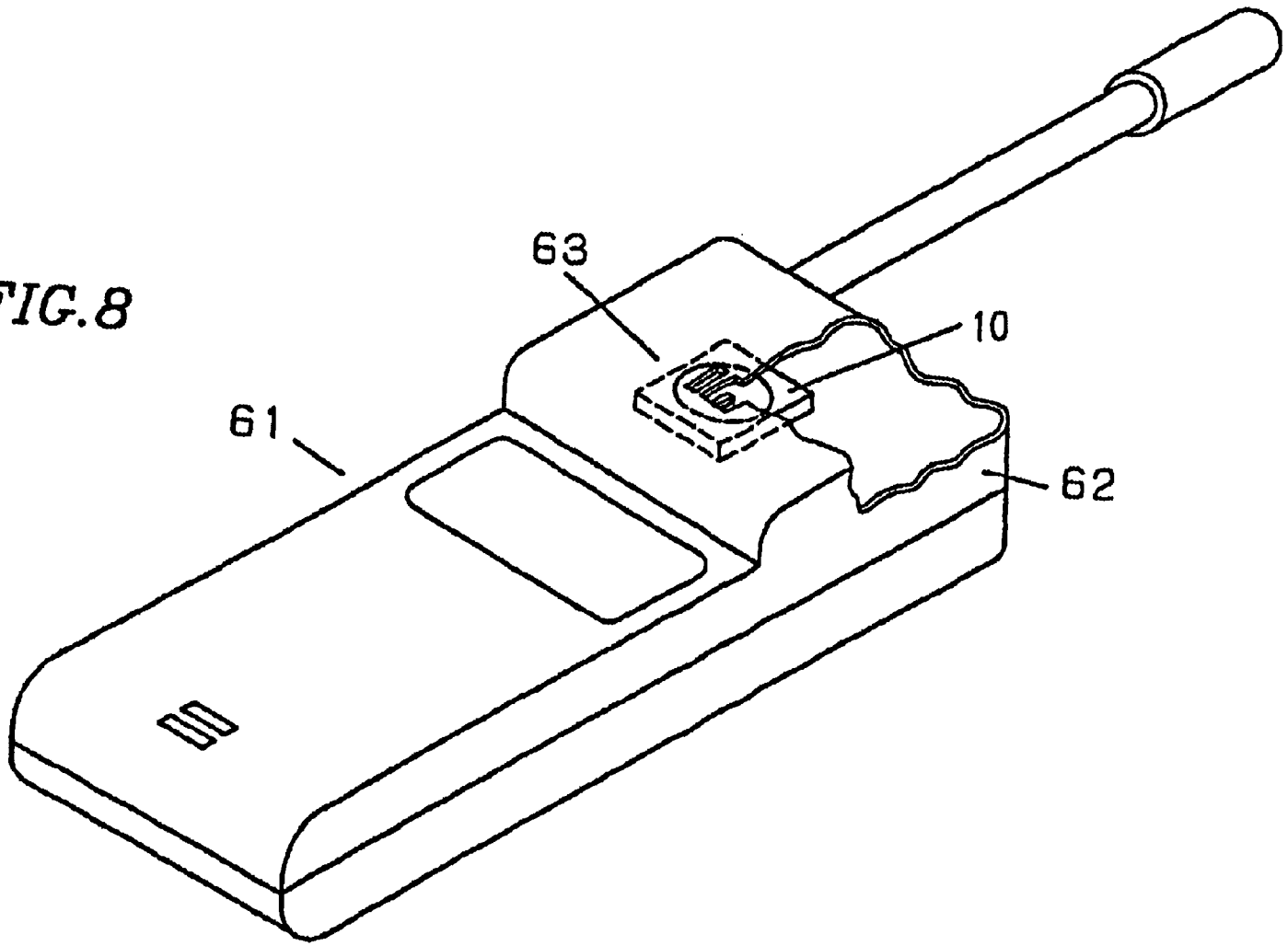
FIG. 8 is a partially-cutaway perspective view illustrating a portable communication device incorporating an electromagnetic transducer according to the present invention.
Figure 9A:
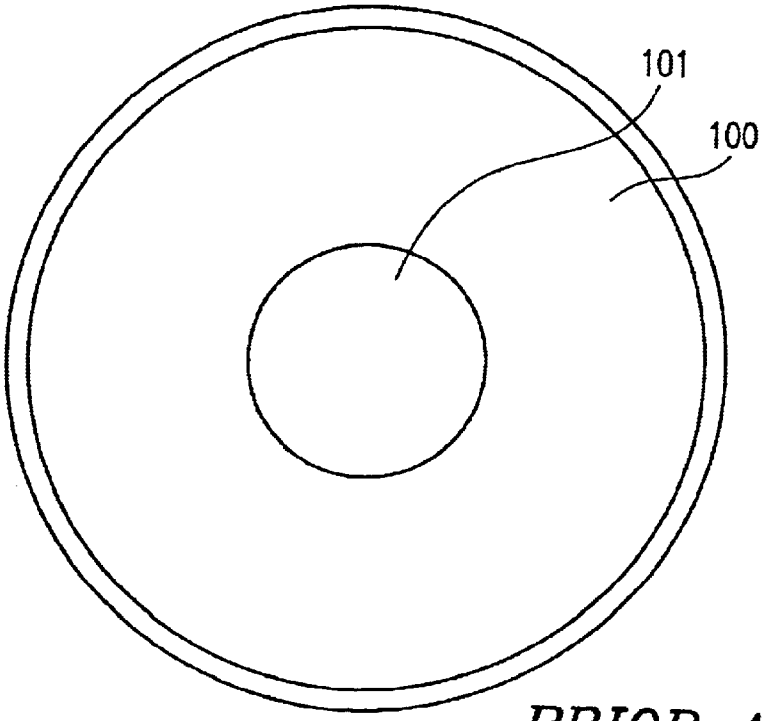
FIG. 9A is a plan view illustrating a conventional electromagnetic transducer.
Figure 9B:
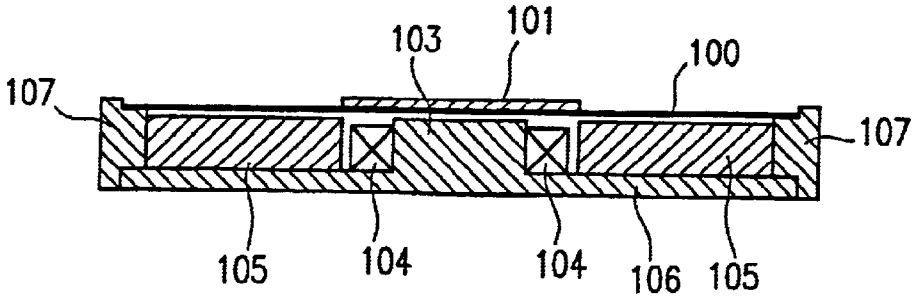
PRIOR ART FIG. 9B
FIG. 9B is a cross-sectional view of the conventional electromagnetic transducer shown in FIG. 9A.
Figure 10:
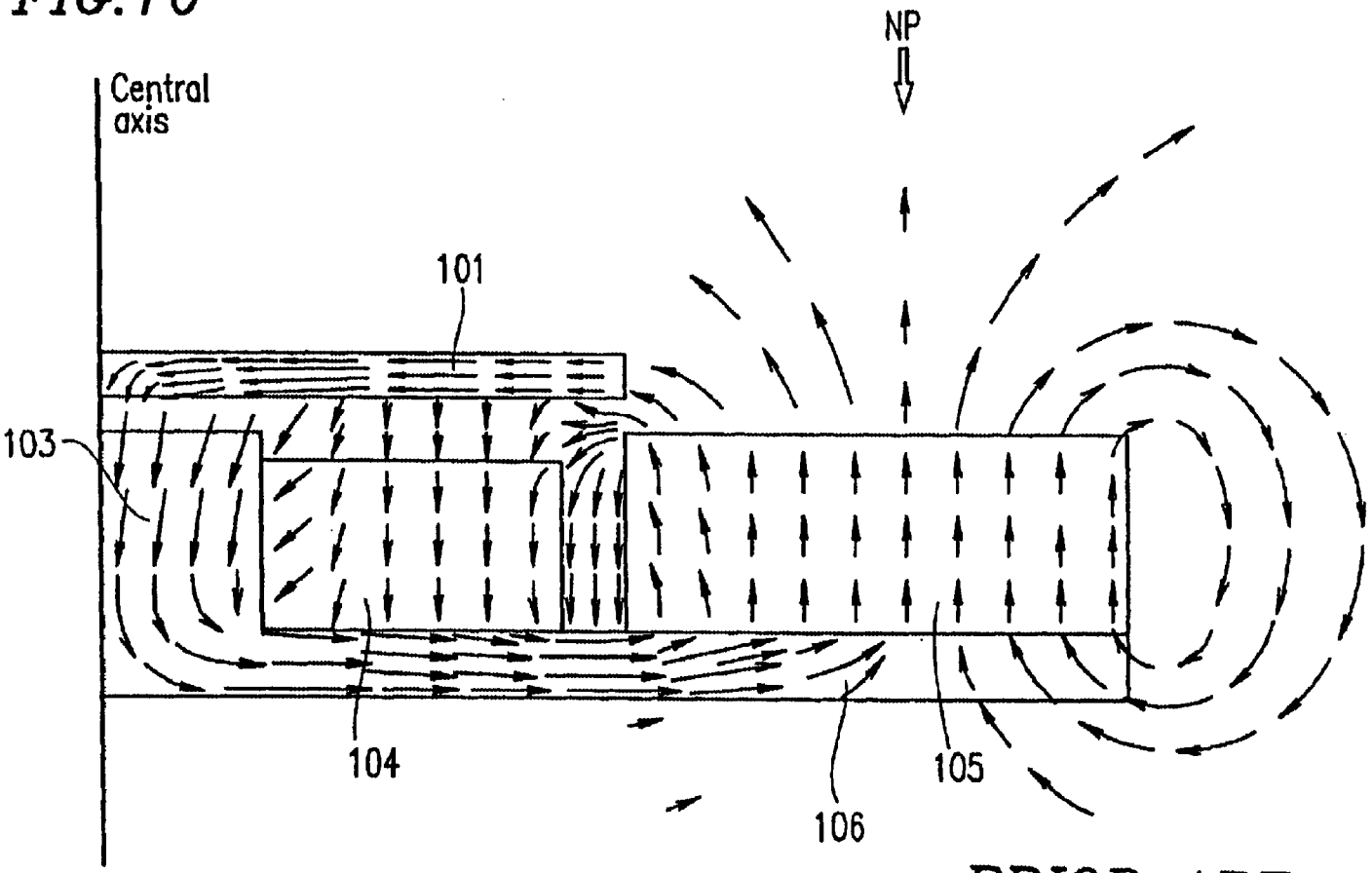
FIG. 10 PRIOR ART
FIG. 10 is a magnetic flux vector diagram of a conventional electromagnetic transducer.

FIG. 8 is a partially-cutaway perspective view illustrating a cellular phone as one implementation of a portable communication device incorporating an electromagnetic transducer according to the present invention. Any one of the electromagnetic transducers illustrated in Examples 1 to 4 may be incorporated in this cellular phone.

The cellular phone 61 includes a housing 62 which has a soundhole 63 formed on one face thereof. Within the housing 62, the electromagnetic transducer 10 according to the present invention is disposed so that the first diaphragm 1 opposes the soundhole 63. The cellular phone 61 has internalized therein a signal processing circuit (not shown) for receiving a transmitted signal and converting a call signal for input to the electromagnetic transducer 10. When the signal processing circuit in the cellular phone 61 receives a signal indicative of a received call, the converted signal is input to the electromagnetic transducer 10, and an alarm sound is reproduced to inform the user of the cellular phone of the received call.

The cellular phone 61 incorporating the electromagnetic transducer 10 according to the present invention can reproduce an alarm sound at a high sound pressure level without even increasing the size of the second diaphragm or the magnet. Accordingly, it is possible to provide an alarm sound at a high sound pressure level without increasing the volumetric size of the cellular phone 61 itself incorporating the electromagnetic transducer 10.

Although the electromagnetic transducer 10 illustrated above is directly mounted to the housing 62 of the cellular phone 61, it may alternatively be mounted on an internal circuit board within the cellular phone 61. An acoustic port for further enhancing the sound pressure level of the alarm sound may additionally be provided.

Although a cellular phone is illustrated in FIG. 8 as one example of a portable communication device, the applications of the present invention are not limited thereto.

In accordance with the electromagnetic transducer, a thin magnetic plate having an inner diameter which is smaller than the outer diameter of a second diaphragm is provided on an upper face of a magnet. As a result, magnetic resistance can be reduced without increasing the size of the magnet or the second diaphragm, thereby increasing attraction force and driving force. This makes it possible to reduce the size of the second diaphragm, which leads to a decrease in the overall mass of the diaphragms and hence an increase in the reproduced sound pressure level. Furthermore, by providing a recessed portion on the upper face of the magnet at its inner periphery for snugly receiving the thin magnetic plate, the overall height of the electromagnetic transducer can be minimized. Furthermore, by providing notches in the second diaphragm and/or constructing the first diaphragm from a material having a relatively small specific gravity, the overall mass of the diaphragms can be further reduced, thereby further improving the reproduced sound pressure level. Furthermore, by providing air holes at the outer periphery of a yoke for releasing the air existing between the first diaphragm and the yoke so that the inner diameter of the thin magnetic plate and the outer diameter of the second diaphragm can be minimized, the elastic support portion of the first diaphragm can be maximized, resulting in large vibration amplitude.

As will be appreciated by those skilled in the art, the first diaphragm may be attached to or supported by any element, other than a housing, in a manner to enable vibration of the first diaphragm. A housing is not an essential requirement in the present invention.

In any of the electromagnetic transducers according to the above-described examples, the thin magnetic plate is not limited the annular-shaped plate. A plurality of magnetic plate may be provided on the magnet.

In any of the electromagnetic transducers according to the above-described examples, an enclosed space is illustrated as being formed by a first diaphragm, a housing, and a yoke. However, an enclosed space may instead be formed by a first diaphragm, a magnet, and a yoke, in which case the first diaphragm may be supported by the magnet. Alternatively, an enclosed space may be formed by a first diaphragm and a housing.

An air hole(s) for allowing the enclosed space to communicate with the exterior of the enclosed space may be provided in any one or more constituent elements composing the electromagnetic transducer according to the present invention.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. An electromagnetic transducer comprising:

a first diaphragm disposed in a vibratile manner;

a second diaphragm in a central portion of the first diaphragm and formed of a magnetic material;

a yoke disposed in a position opposing the first diaphragm;

a center pole on a face of the yoke that opposes the first diaphragm;

a coil substantially surrounding the center pole;

a magnet substantially surrounding the coil; and a thin magnetic plate between the magnet and the first diaphragm and having:

(a) an outer peripheral edge, and (b) an inner periphery in overlapping relation to an outer periphery of the second diaphragm, wherein the outer peripheral edge of the thin magnetic plate substantially coincides with a neutral point at which directions of magnetic flux vectors occurring on a surface of the magnet become diversified so that some of the magnetic flux vectors traverse toward the center pole while others traverse toward an outer periphery of the magnet.

2. An electromagnetic transducer according to claim 1, wherein at least one of the first diaphragm, the magnet, and the yoke includes at least one air hole for allowing a space formed by the first diaphragm, the magnet, and the yoke to communicate with the exterior of the space.

3. A portable communication device incorporating an electromagnetic transducer according to claim 2.

4. An electromagnetic transducer according to claim 1 further comprising a housing, the first diaphragm being provided in the housing.

5. An electromagnetic transducer according to claim 4, wherein at least one of the first diaphragm and the housing includes at least one air hole for allowing a space formed by the first diaphragm and the housing to communicate with the exterior of the space.

6. A portable communication device incorporating an electromagnetic transducer according to claim 5.

7. An electromagnetic transducer according to claim 4, wherein at least one of the first diaphragm, the housing, and the yoke includes at least one air hole for allowing a space formed by the first diaphragm, the housing, and the yoke to communicate with the exterior of the space.

8. An electromagnetic transducer according to claim 7, wherein the at least one air hole is provided in a position along a diameter of the yoke located outside an outer periphery of the magnet.

9. A portable communication device incorporating an electromagnetic transducer according to claim 8.

10. A portable communication device incorporating an electromagnetic transducer according to claim 7.

11. A portable communication device incorporating an electromagnetic transducer according to claim 4.

12. An electromagnetic transducer according to claim 1, wherein an inner diameter of the thin magnetic plate is equal to or smaller than an inner diameter of the magnet.

13. A portable communication device incorporating an electromagnetic transducer according to claim 12.

14. An electromagnetic transducer according to claim 1, wherein the second diaphragm includes a plurality of projections, each of which extends in a radial direction, the plurality of projections being formed along a circumference direction or the second diaphragm.

15. A portable communication device incorporating an electromagnetic transducer according to claim 14.

16. An electromagnetic transducer according to claim 1, wherein a material substantially composing the first diaphragm has a specific gravity which is equal to or smaller than a specific gravity of a material substantially composing the second diaphragm.

17. A portable communication device incorporating an electromagnetic transducer according to claim 16.

18. A portable communication device incorporating an electromagnetic transducer according to claim 1.

19. An electromagnetic transducer according to claim 1, wherein a length of radial overlap between an outer diameter of the second diaphragm and an inner diameter of the thin magnetic plate accounts for about 4% to about 15% of the outer diameter of the second diaphragm.

20. A portable communication device incorporating an electromagnetic transducer according to claim 19.

21. An electromagnetic transducer comprising:

a first diaphragm disposed in a vibratile manner;

a second diaphragm provided in a central portion of the first diaphragm, the second diaphragm being formed of a magnetic material;

a yoke disposed in a position opposing the first diaphragm;

a center pole provided on a face of the yoke that opposes the first diaphragm;

a coil substantially surrounding the center pole;

a magnet substantially surrounding the coil; and a thin magnetic plate provided between the magnet and the first diaphragm, an inner periphery of the thin magnetic plate being in overlapping relation to an outer periphery of the second diaphragm, wherein the magnet includes a recessed portion on a face thereof opposing the first diaphragm at an inner periphery thereof, the thin magnetic plate being snugly received by the recessed portion.

22. A portable communication device incorporating an electromagnetic transducer according to claim 21.

23. An electromagnetic transducer according to claim 21, wherein a length of radial overlap between an outer diameter of the second diaphragm and an inner diameter of the thin magnetic plate accounts for about 4% to about 15% of the outer diameter of the second diaphragm.

* * * * *